US008075166B2

(12) United States Patent
Ohno et al.

(10) Patent No.: US 8,075,166 B2
(45) Date of Patent: Dec. 13, 2011

(54) VEHICLE LIGHT

(75) Inventors: Masafumi Ohno, Tokyo (JP); Ryotaro Owada, Tokyo (JP); Norikatsu Myojin, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 16 days.

(21) Appl. No.: 12/820,120

(22) Filed: Jun. 21, 2010

(65) Prior Publication Data

US 2010/0321949 A1 Dec. 23, 2010

(30) Foreign Application Priority Data

Jun. 19, 2009 (JP) ..... 2009-146741

(51) Int. Cl.
*F21V 7/00* (2006.01)

(52) U.S. Cl. ..... 362/310; 362/507; 362/538; 362/511

(58) Field of Classification Search ..... 362/507, 362/509, 511, 538, 800, 310; 359/800
See application file for complete search history.

(56) References Cited

U.S. PATENT DOCUMENTS 5,173,810 A * 12/1992 Yamakawa ..... 359/819
6,552,368 B2 * 4/2003 Tamai et al. ..... 257/98
6,565,247 B2 * 5/2003 Thominet ..... 362/545
6,960,007 B2 * 11/2005 Ishida et al. ..... 362/538
7,070,312 B2 7/2006 Tatsukawa
7,806,558 B2 * 10/2010 Williamson ..... 362/241
7,901,108 B2 * 3/2011 Kabuki et al. ..... 362/235

FOREIGN PATENT DOCUMENTS

JP 2005-11704 A 1/2005

* cited by examiner

*Primary Examiner* — Ali Alavi
(74) *Attorney, Agent, or Firm* — Kenealy Vaidya LLP

(57) ABSTRACT

A light, and particularly a vehicle light, can prevent a reflected image of a resin injection trace (reflected in an adjacent connecting surface surrounding a reflecting surface) from being observed through a projecting surface, thereby preventing deterioration of appearance of the light. The light can include a light source and a lens body having a resin injection trace by injection molding. The lens body can include, as its surface, optical surfaces including an incident surface, a reflecting surface, and a projecting surface that are configured to form a predetermined light distribution pattern. Connecting surfaces that shape and define a structure of the lens body can connect the optical surfaces, and can be configured so as not to engage in the formation of the light distribution pattern. The incident surface can be a lens surface that can receive light from the light source to allow the light to enter the lens body. The reflecting surface can reflect the light from the light source toward the projecting surface so as to form the light distribution pattern. The projecting surface can be a lens surface that can receive the light directly from the light source and the light reflected by the reflecting surface, and project the same. The adjacent connecting surface of the connecting surfaces can be configured so as not to generate a light path from the resin injection trace via the connecting surface to the projecting surface.

20 Claims, 15 Drawing Sheets

VEHICLE LIGHT

This application claims the priority benefit under 35 U.S.C. §119 of Japanese Patent Application No. 2009-146741 filed on Jun. 19, 2009, which is hereby incorporated in its entirety by reference.

TECHNICAL FIELD

The presently disclosed subject matter relates to a vehicle light, and in particular, to a vehicle light utilizing a lens body having optical surfaces including an incident surface, a reflecting surface, and a projecting surface configured to form a predetermined light distribution pattern, and connecting surfaces which shape and define the structure of the lens body by connecting the optical surfaces, but which do not engage in the formation of the light distribution pattern.

BACKGROUND ART

One conventional vehicle light 400 is illustrated as a conceptual diagram in FIG. 1. This type of vehicle light 400 can be configured to include a lens body 410 having a recess, and a light source (such as an LED light source) 420 disposed within the recess of the lens body 410. The lens body 410 can include optical surfaces (including an incident surface 414*a*, a reflecting surface 412*a*, and a projecting surface 411*a*) that are configured to form a predetermined light distribution pattern, and connecting surfaces 416 and the like which shape and define the structure of the lens body by connecting the optical surfaces, but which do not engage in the formation of the light distribution pattern). In the vehicle light 400, the lens body 410 can include a recess and the LED light source 420 can be disposed within the recess so that the light emitted by the LED light source 420 can be guided toward the lens body and reflected to form a predetermined light distribution pattern (see for example, Japanese Patent Application Laid-Open No. 2005-11704).

Another exemplary vehicle light (500) is illustrated in FIG. 2, which has a similar configuration as compared to the conventional vehicle light shown in FIG. 1. FIG. 1 shows the vehicle light 500 including a lens body 510 having optical surfaces and connecting surfaces, and an LED light source 520. The vehicle light 500 can include a lens body 510 including optical surfaces (including an incident surface 514*a*, a reflecting surface 512*a*, and a projecting surface 511*a*) and connecting surfaces (surfaces 516, 512*b* and the like), and an LED light source 520. In this case, due to the design requirement or the size of the lens body 510, a resin injection trace 516*a* (or gate trace) that remains from the injection molding process may be reflected in the adjacent connecting surface 512*b* surrounding the reflecting surface 512*a*. This reflected image may be observed through the projecting surface 511*a*, thereby adversely affecting the appearance (as a product value).

A vehicle light is also disclosed in Applicant's co-pending patent application, U.S. patent application Ser. No. 12/820,117, filed on same date, Jun. 21, 2010, which is hereby incorporated in its entirety by reference.

Furthermore, in the vehicle light 500 in which the lens body 510 can include the reflecting surface 512*a* and the connecting surface 512*b* surrounding the reflecting surface 512*a* on the same plane (on the same side surface), the shape of the lens body 510 may be limited due to its size and/or design requirement. In addition, the light emitted from the LED light source having a wide light directivity can be available within the lens body 510 in a limited amount. Due to these and other reasons, the light emitted from the LED light source 520 and entering the lens body 510 may partly enter the connecting surface to be reflected by the same, so that the light may exit the lens body 510 through the projecting surface and become glare light.

SUMMARY

The presently disclosed subject matter was devised in view of these and other problems and features and in association with the conventional art. According to an aspect of the presently disclosed subject matter, a light (or vehicle light) can prevent a reflected image of a resin injection trace reflected in an adjacent connecting surface surrounding the reflecting surface from being observed through a projecting surface, thereby preventing the deterioration of the appearance of the light.

According to another aspect of the presently disclosed subject matter, a light (or a vehicle light) can prevent the generation of glare light due to the reflection of light from a connecting surface surrounding a reflecting surface when a lens body including the reflecting surface and the connecting surface surrounding the reflecting surface is used and light emitted from an LED light source enter the lens body. According to another aspect of the presently disclosed subject matter, a light can include a light source and a lens body having a resin injection trace by injection molding. The lens body can include, as its surface, optical surfaces including an incident surface, a reflecting surface, and a projecting surface that are configured to form a predetermined light distribution pattern, and connecting surfaces that shape and define a structure of the lens body by connecting the optical surfaces, but that do not engage in the formation of the light distribution pattern. The incident surface can be configured to include a lens surface that can receive light from the light source to allow the light to enter the lens body. The reflecting surface can be configured to reflect the light from the light source toward the projecting surface so as to form the light distribution pattern. The projecting surface can be configured to include a lens surface that can receive the light directly from the light source and the light reflected by the reflecting surface and project the same. The connecting surfaces can include an adjacent connecting surface surrounding the reflecting surface. The adjacent connecting surface cannot generate a light path from the resin injection trace via the connecting surface to the projecting surface.

The light having the above configuration can have the adjacent connecting surface surrounding the reflecting surface with the shape thereof configured so that the adjacent connecting surface cannot generate a light path from the resin injection trace via the connecting surface to the projecting surface. Accordingly, there is no light pass formed from the resin injection trace via the connecting surfaces surrounding the reflecting surface to the projecting surface.

The light (or vehicle light) with this configuration can prevent a reflected image of a resin injection trace reflected in the adjacent connecting surface surrounding the reflecting surface from being observed through the projecting surface, thereby preventing the deterioration of the appearance.

According to still another aspect of the presently disclosed subject matter, a light can include a light source and a lens body having a resin injection trace by injection molding. The lens body can include, as its surface, optical surfaces including an incident surface, a reflecting surface, and a projecting surface that are configured to form a predetermined light distribution pattern, and connecting surfaces that shape and define a structure of the lens body by connecting the optical surfaces, but that do not engage in the formation of the light distribution pattern. The incident surface can be configured to include a lens surface that can receive light from the light source to allow the light to enter the lens body. The reflecting surface can be configured to reflect the light from the light source toward the projecting surface so as to form the light distribution pattern. The projecting surface can be configured to include a lens surface that can receive the light directly from the light source and the light reflected by the reflecting surface and project the same. The connecting surfaces can include an adjacent connecting surface surrounding the reflecting surface. The adjacent connecting surface can be configured to have a shape that can reflect the resin injection trace so that the reflected image cannot be recognized as a resin injection trace.

The light having the above configuration can have the adjacent connecting surface surrounding the reflecting surface with the shape thereof configured so as to reflect the resin injection trace so that the reflected image cannot be recognized as a resin injection trace. Accordingly, the light (or vehicle light) with this configuration can prevent a reflected image of a resin injection trace reflected in the adjacent connecting surface surrounding the reflecting surface from being recognized as a resin injection trace even when it is observed from outside.

Thus, the light can prevent the deterioration of the appearance due to the reflected image of a resin injection trace in the connecting surface viewed through a projecting surface.

According to still another aspect of the presently disclosed subject matter, a light can include a light source and a lens body having a resin injection trace by injection molding. The lens body can include, as its surface, optical surfaces including an incident surface, a reflecting surface, and a projecting surface that are configured to form a predetermined light distribution pattern, and connecting surfaces that shape and define a structure of the lens body by connecting the optical surfaces, but that do not engage in the formation of the light distribution pattern. The incident surface can be configured to include a lens surface that can receive light from the light source to allow the light to enter the lens body. The reflecting surface can be configured to reflect the light from the light source toward the projecting surface so as to form the light distribution pattern. The projecting surface can be configured to include a lens surface that can receive the light directly from the light source and the light reflected by the reflecting surface and project the same. The connecting surfaces can include an adjacent connecting surface surrounding the reflecting surface. The adjacent connecting surface can be configured to be subjected to grain finishing and to thus have a grain-finished surface.

The light having the above configuration can have the adjacent connecting surface surrounding the reflecting surface with the grain-finished surface. Accordingly, even when the resin injection trace is reflected in the adjacent connecting surface, the reflected image of the resin injection trace can be diffused well. This can prevent the image of the resin injection trace from being recognized as a resin injection trace.

Thus, the light can prevent the deterioration of the appearance due to the reflected image of a resin injection trace in the connecting surface viewed through a projecting surface.

According to still further another aspect of the presently disclosed subject matter, a light can include a light source and a lens body having a resin injection trace by injection molding. The lens body can include, as its surface, optical surfaces including an incident surface, a reflecting surface, and a projecting surface that are configured to form a predetermined light distribution pattern, and connecting surfaces that shape and define a structure of the lens body by connecting the optical surfaces, but that do not engage in the formation of the light distribution pattern. The incident surface can be configured to include a lens surface that can receive light from the light source to allow the light to enter the lens body. The reflecting surface can be configured to reflect the light from the light source toward the projecting surface so as to form the light distribution pattern. The projecting surface can be configured to include a lens surface that can receive the light directly from the light source and the light reflected by the reflecting surface, and project the same. The connecting surfaces of the lens body other than the optical surfaces can be covered with any of a colored layer and a translucent layer.

The light having the above configuration can have the connecting surfaces other than the optical surfaces covered with any of a colored layer and a translucent layer. Accordingly, this can prevent any unintended light from being reflected by the connecting surfaces and projected through the projecting surface.

Accordingly, the light emitted from the LED light source and entering the lens body can be prevented from becoming glare light by being reflected by the connecting surface surrounding the reflecting surface.

In the above-mentioned configuration, the light source can be an LED light source. If an LED which generates less heat is used as the light source, even when the lens body is made of a resin and the light source is disposed nearby the resin-made lens body, the lens body may not be affected by heat generated by the light source, thereby preventing the lens body from being deformed and ensuring the maintenance of the dimension of the lens body.

The lens body can be molded by injection molding a transparent resin as a unit. This resin-made lens body can be used together with the LED light source with less heat generation, thereby configuring inexpensive lens body with high accuracy.

In the above-mentioned configuration, the lens body can have a substantial cubic shape including a bottom surface, side surfaces, a front surface, a rear surface and a top surface. In this case, the incident surface can be arranged in the bottom surface, the projecting surface can be arranged in the front surface, and the reflecting surface can be arranged in the rear surface. In this configuration, the adjacent connecting surface can be arranged in the same rear surface as the reflecting surface, so that the adjacent connecting surface can obscure the image of the resin injection trance reflected therein. Accordingly, this configuration can obscure the reflected image of the resin injection traces in the adjacent connecting surface by diffusion or the like, and thus, can prevent the reflected image from being observed through the projecting surface.

The light made in accordance with the principles of the presently disclosed subject matter can be various types of lights, including a vehicle light for use as a vehicle headlight, a vehicle signal light, a vehicle fog light, and the like.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to lights made in accordance with principles of the presently disclosed subject matter with reference to the accompanying drawings in accordance with exemplary embodiments.

A vehicle light 100 of the exemplary embodiment as shown in FIGS. 3 to 6 can be utilized as a vehicle light (for example, a headlamp, a signal lamp and the like for use in automobiles, motorcycles and the like). The vehicle light 100 of FIGS. 3 to 6 can include a lens body 10 made of a transparent resin, a light source 20, and the like. The lens body 10 can also include a resin injection trace 16*a* (or so-called gate trace) which results from an injection molding. An injection trace or gate trace typically occurs where, in a final step of the injection molding process, a final injection molded product is separated from the material that leads up to but is not part of the final product. For example, many injection molds include a runner and sprue that lead from a reservoir of material (e.g., molten resin material, etc.) to the cavity in which the final product is molded. When the final product is separated from the mold, the final product material is cut, separated, broken or otherwise removed from the material located in the runner and sprue. That separation point may be visible or may have different optical characteristics as compared to the remaining portion of the final molded product, and is typically referred to as the injection trace or gate trace.

Figure 1:
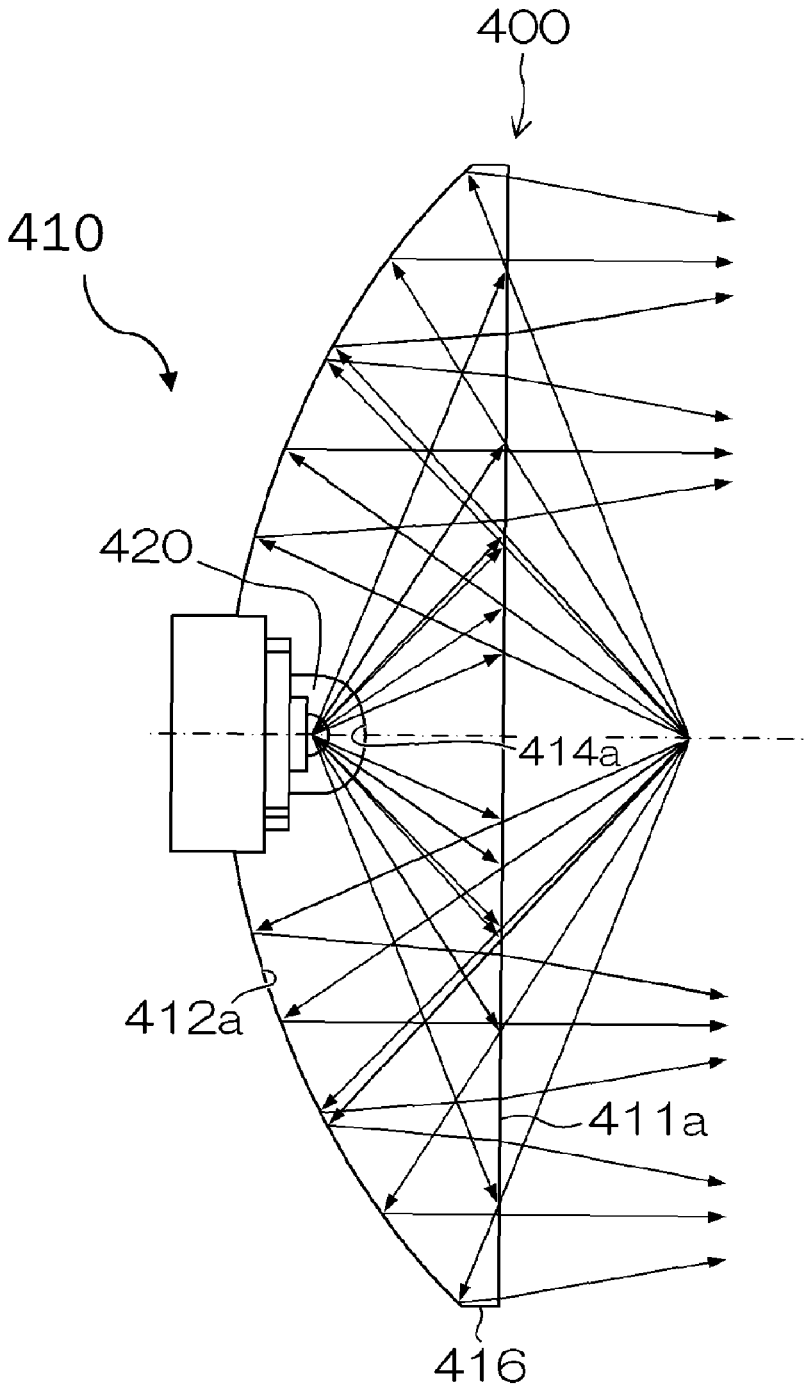
Fig. 1 Conventional Art
FIG. 1 is a conceptual diagram illustrating a conventional vehicle light.
Figure 2:
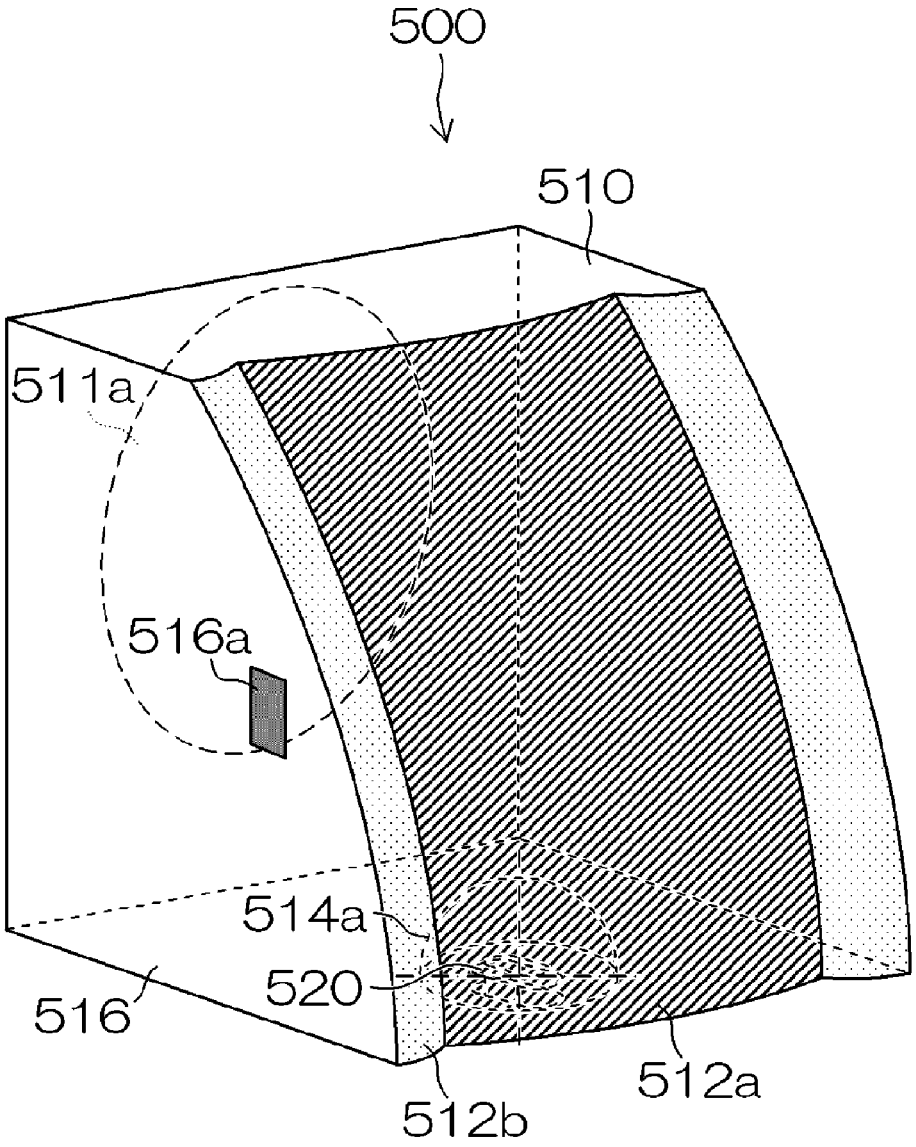
Fig. 2 Conventional Art
FIG. 2 is a perspective view illustrating another conventional vehicle light including a lens body having an adjacent connecting surface surrounding a reflecting surface.
Figure 3:
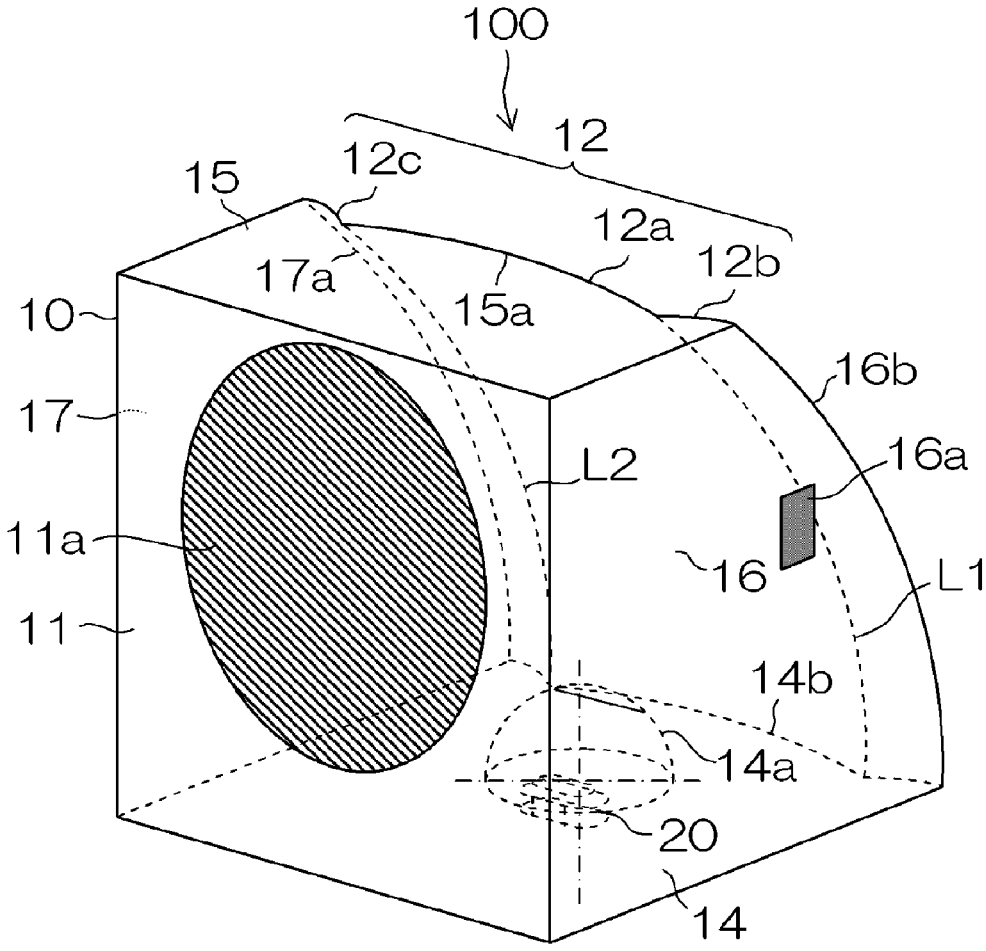
FIG. 3 is a perspective view illustrating a light according to one exemplary embodiment made in accordance with principles of the presently disclosed subject matter.
Figure 4:
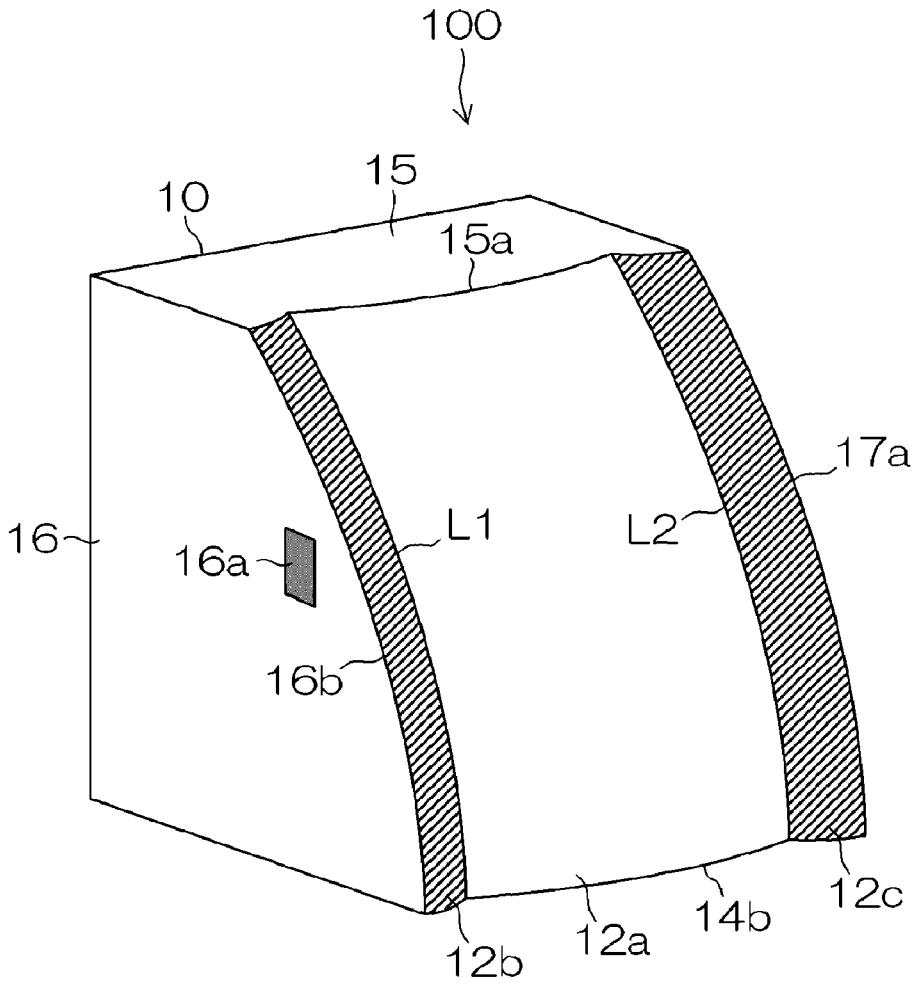
FIG. 4 is a perspective view illustrating the light of FIG. 3, as viewed from its rear side.
Figure 5:
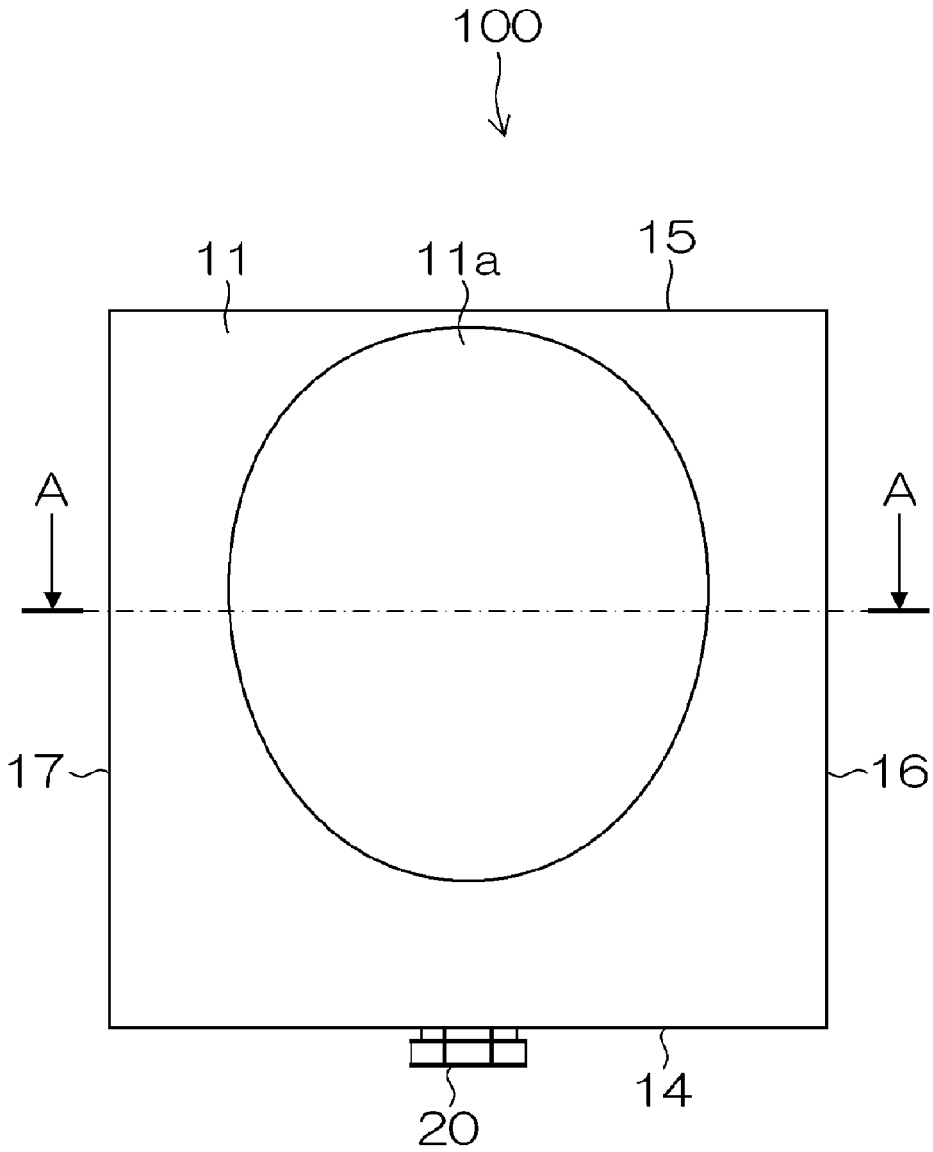
FIG. 5 is a front view illustrating the light of FIG. 3.

The lens body 10 can be molded by injection molding a transparent resin such as acrylic resin, polycarbonate resin or the like to be a solid lens body. As shown in FIGS. 3 and 4, the lens body 10 can include a front surface 11 that is positioned in the front side of a vehicle body and can include a projecting surface 11*a*, a rear surface 12 that is positioned in the rear side and can include a reflecting surface 12*a* and an adjacent connecting surface 12*b*, a bottom surface 14 that includes an incident surface 14*a*, an upper surface 15, and side surfaces 16 and 17 including the resin injection trace 16*a* (being a trace formed by an injection molding gate). These surfaces can define the lens body 10 as a substantially cubic shape. It should be noted that in FIGS. 3, 4, and 6 the resin injection trace 16*a* is shown only on the side surface 16, but may be formed on the other side surface 17.

The incident surface 14*a* can be a lens surface that can allow the light emitted from the light source 20 to enter the lens body 10, and can be formed in the bottom surface 14. In FIG. 3, the incident surface 14*a* is shown as a semispherical concave surface toward the inside of the lens body 10.

The reflecting surface 12*a* can be configured to reflect the incident light from the light source 20 in a predetermined direction so as to form a predetermined light distribution pattern, and can be a revolved parabolic reflecting surface. The reflecting surface 12*a* can be formed by forming a convex area between the adjacent connecting surfaces 12*b* and 12*c* (or two lines L1 and L2) in the width direction and between a rear side edge 14*b* of the bottom surface 14 and a rear side edge 15*a* of the top surface 15 in the vertical direction and then depositing metal such as Al thereon.

The projecting surface 11*a* can be a lens surface configured to project light directly from the light source 20 and/or the light reflected from the reflecting surface 12*a*, and can be formed in the front surface 11 of the lens body 10. The projecting surface 11*a* can be covered with an anti-reflection film, if necessary.

The light source 20 can be composed of one or a plurality of LED chips in a packaged form. The light source 20 can be fixed to the lens body 10 by means of, for example, a sealant like a transparent resin so that the light emitted therefrom can be incident on the incident surface 14*a* of the lens body 10. Since an LED can be utilized as the light source 20, the adverse effect of heat on the resin-made lens body 10 can be reduced.

The connecting surface 12*b*, which corresponds to an example of an adjacent connecting surface surrounding the reflecting surface, can be configured to shape and define the structure of the lens body 10, but does not engage in the formation of the light distribution pattern. Here, the connecting surface 12*b* can be formed in the rear surface 12 to be disposed beside the reflecting surface 12*a* or between the line L1 and the rear side edge 16*b* of the side surface 16 as shown in FIGS. 3 to 6. Similarly, the connecting surface 12*c* which also corresponds to an exemplary adjacent connecting surface surrounding the reflecting surface can be configured to shape and define the structure of the lens body 10, but does not engage in the formation of the light distribution pattern. Here, the connecting surface 12*c* can be formed in the rear surface 12 to be disposed beside the reflecting surface 12*a* or between the line L2 and the rear side edge 17*a* of the side surface 17 as shown in FIGS. 3 to 6.

Figure 6:
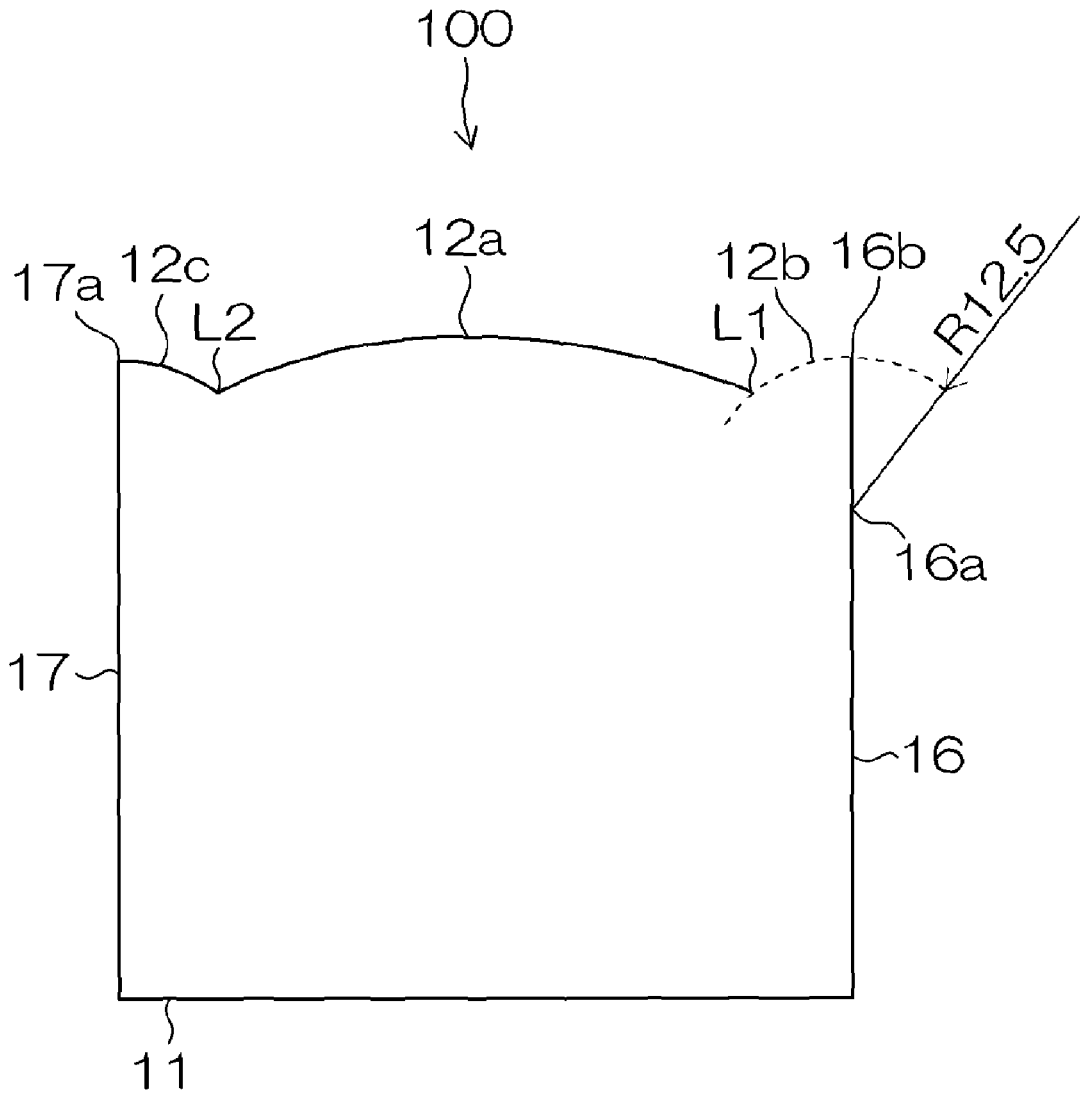
FIG. 6 is a cross-sectional view illustrating the light, taken along line A-A in FIG. 5.

In this configuration, the adjacent connecting surface 12*b* can be configured to be a shape that does not generate a light path from the resin injection trace 16*a* via the connecting surface 12*b* to the projecting surface 11*a* (the same can be true for the adjacent connecting surface 12*c*). As shown in FIG. 6, for example, the adjacent connecting surface 12*b* can be formed by a curved surface that has a cross section parallel to the bottom surface 14 being an arc the center of which is the resin injection trace 16*a*. As shown in FIG. 6, the arc can have a radius of 12.5 mm. Alternatively, the curved surface can be convex toward the resin injection trace 16*a* (not shown). This configuration can prevent a light path from the resin injection trace 16*a* via the connecting surface 12*b* to the projecting surface 11*a* from being generated. The vehicle light as configured above can prevent a reflected image of the resin injection trace 16*a* reflected in the adjacent connecting surface 12*b* surrounding the reflecting surface from being observed through the projecting surface 11*a*, thereby preventing the deterioration of appearance of the light. Namely, it is difficult to observe the resin injection trace 16*a* when viewing the vehicle light from its front side.

Next, a description will be given of another exemplary embodiment including several modified examples with reference to FIGS. 7 to 11.

In the previous exemplary embodiment, the adjacent connecting surface 12*b* (or 12*c*) can be configured to be a shape that does not generate a light path from the resin injection trace 16*a* via the connecting surface 12*b* to the projecting surface 11*a*. The resin injection trace 16*a* can also be concealed by the following different structures.

In one exemplary embodiment, the adjacent connecting surface 12*b* can be configured to allow the resin injection trace 16*a* to be reflected in the connecting surface 12*b* but be unable to be recognized as a resin injection trace.

Figure 7:
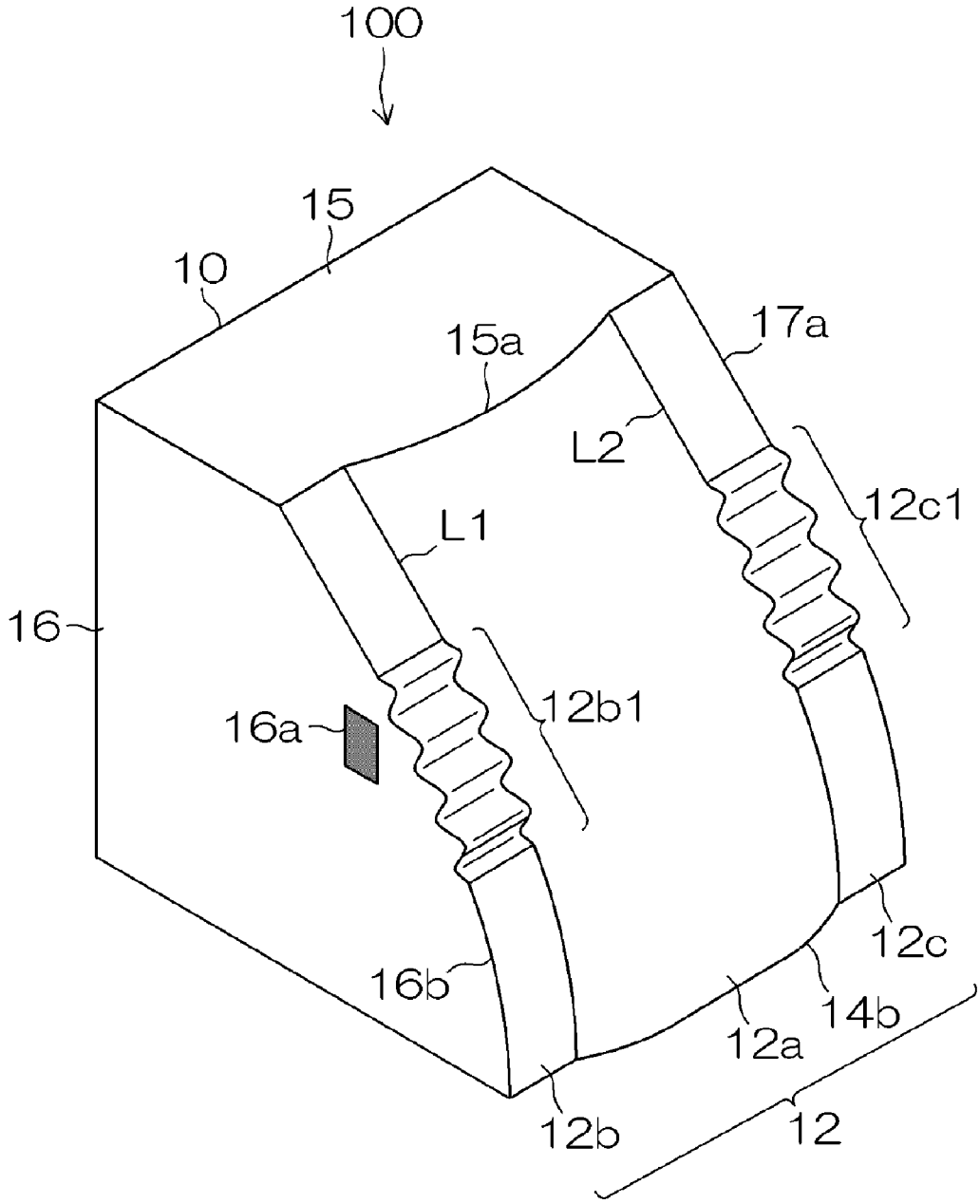
FIG. 7 is a perspective view illustrating a light according to another exemplary embodiment made in accordance with principles of the presently disclosed subject matter.

FIG. 7 shows a lens body 100 according to the exemplary embodiment, including the adjacent connecting surfaces 12*b* (12*c*) with sections 12*b*1 (12*c*1) having a concavo-convex surface wherein a plurality of horizontal ridges are adjacent to each other in the vertical direction (the horizontal ridges connected by horizontal valleys with curved surfaces).

In this exemplary embodiment, the adjacent connecting surfaces 12*b* (12*c*) can be configured to allow the resin injection trace 16*a* to be reflected in the adjacent connecting surface 12*b* but be unable to be recognized as a resin injection trace due to the presence of sections 12*b*1 (12*c*1). Accordingly, even when the resin injection trace 16*a* is reflected in the connecting surface 12*b*, it may be difficult to observe the resin injection trance 16*a* through the projecting surface 11*a*, but instead one can observe an unclear image obscured by the section 12*b*1 (12*c*1).

Therefore, the vehicle light 100 can prevent the reflected image of a resin injection trace that is reflected in an adjacent connecting surface surrounding the reflecting surface from being observed through a projecting surface, thereby preventing the deterioration of the appearance of the light.

Figure 8:
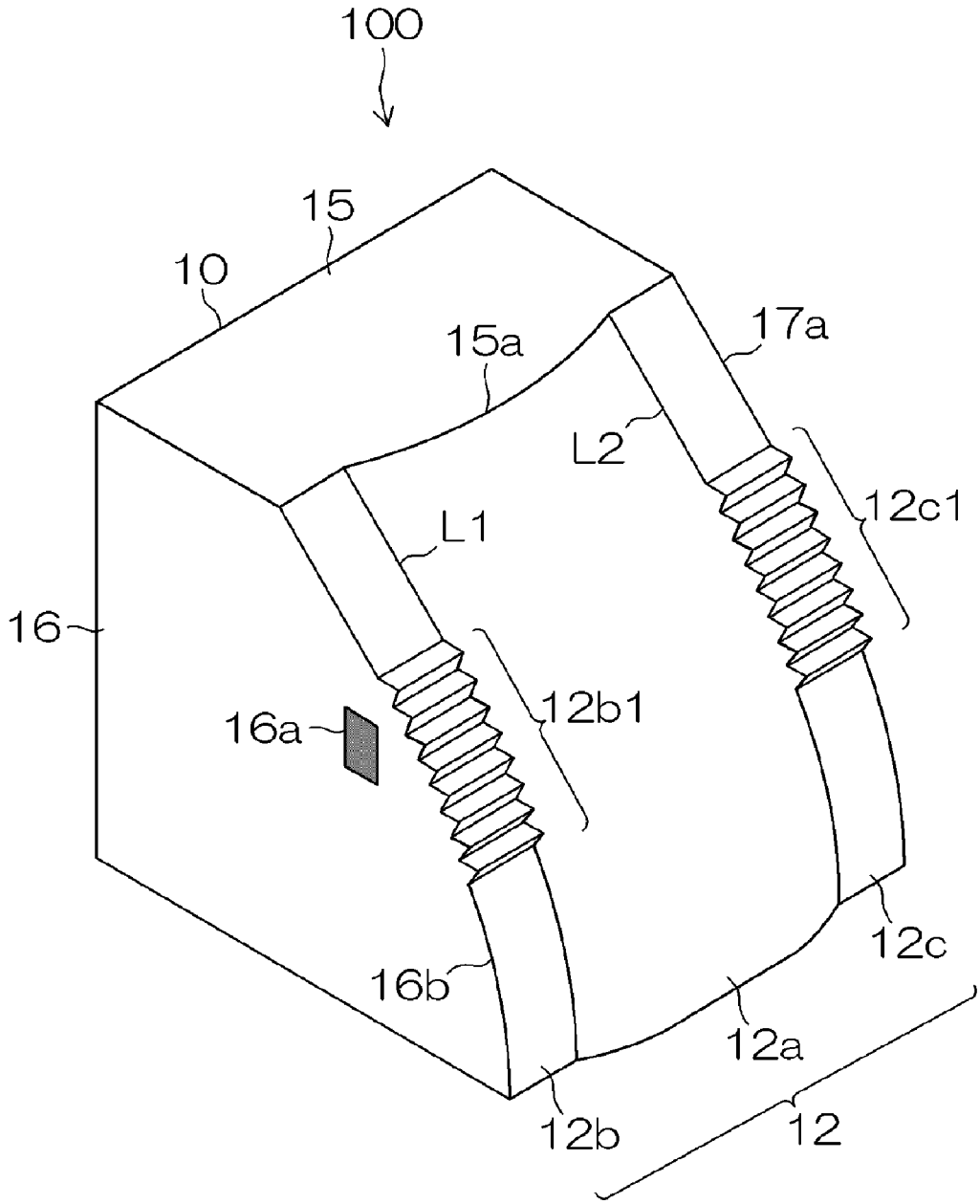
FIG. 8 is a perspective view illustrating the light, which is one modified example of the previous exemplary embodiment of FIG. 7.
Figure 9:
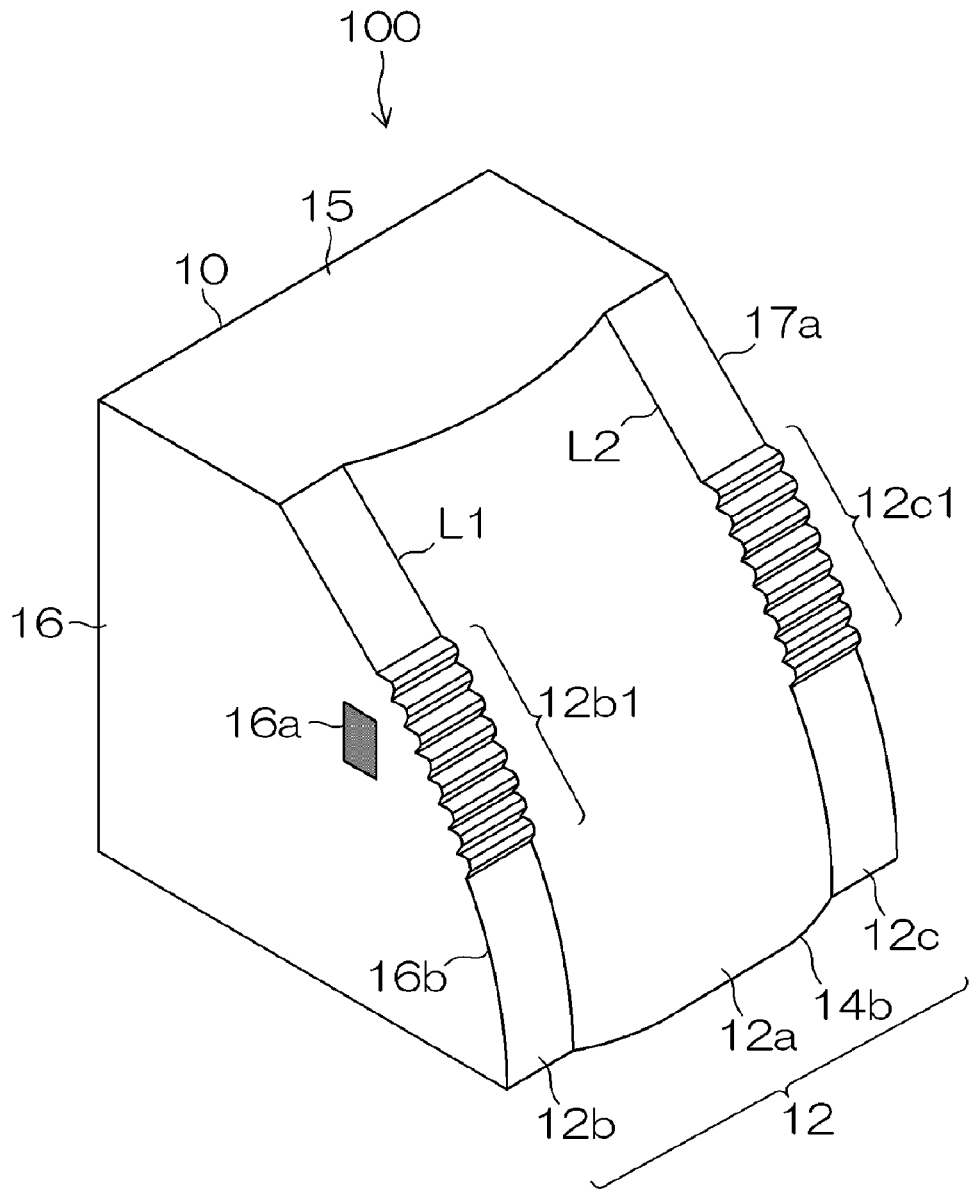
FIG. 9 is a perspective view illustrating the light, which is still another modified example of the previous exemplary embodiment of FIG. 7.

FIGS. 8 and 9 illustrate modified examples of the exemplary embodiment shown in FIG. 7. As shown, the adjacent connecting surfaces 12*b* (12*c*) can include sections 12*b*1 (12*c*1) having a plurality of horizontal lens cuts. The horizontal lens cuts are adjacent to each other in the vertical direction and connected to each other via sharp horizontal valleys. The modified example illustrated in FIG. 8 has section 12*b*1 with sharp horizontal lens cuts, while another modified example illustrated in FIG. 9 has section 12*b*1 with rounded horizontal lens cuts.

Figure 10:
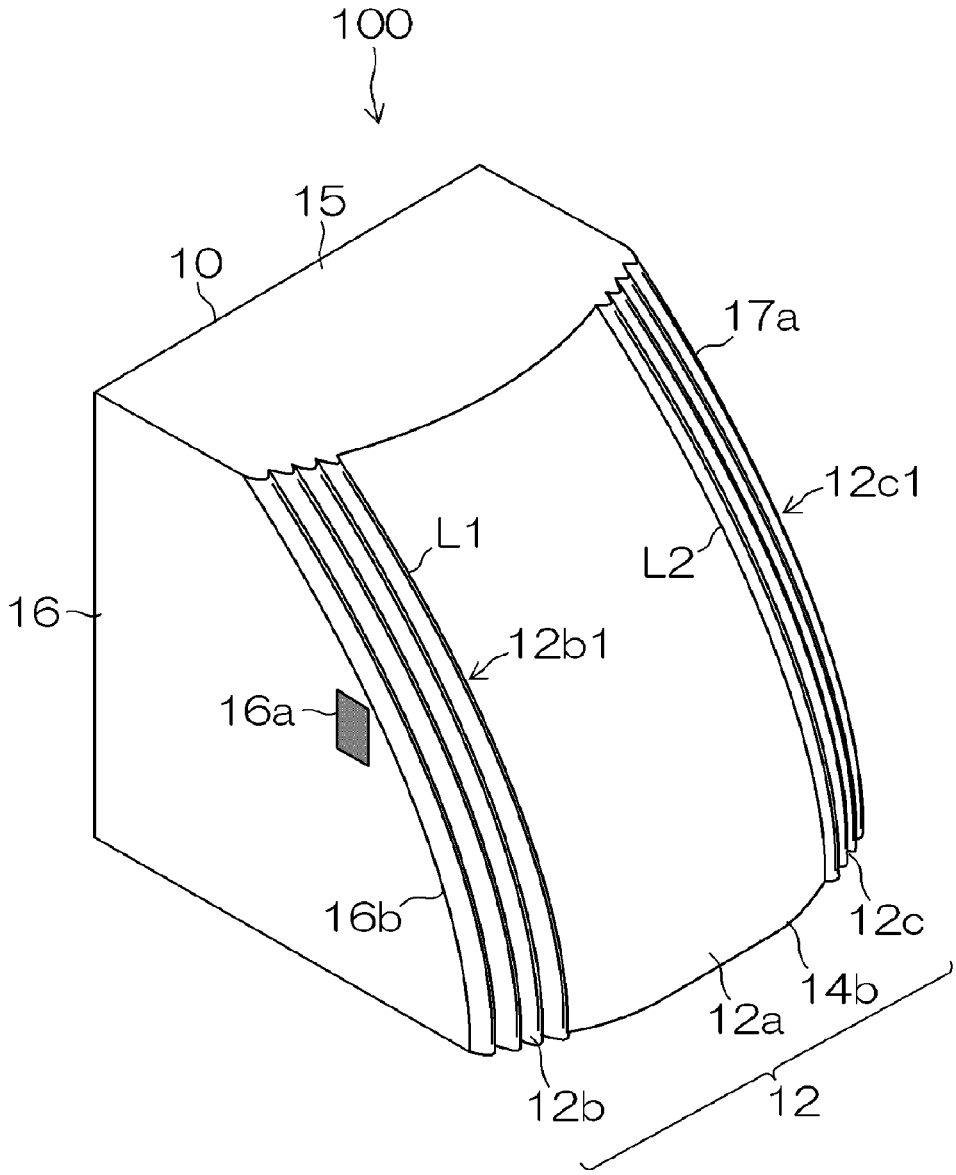
FIG. 10 is a perspective view illustrating the light, which is further another modified example of the previous exemplary embodiment of FIG. 7.

FIG. 10 illustrates still another modified example of the exemplary embodiment shown in FIG. 7. As shown, the adjacent connecting surfaces 12*b* (12*c*) can include sections 12*b*1 (12*c*1) having a plurality of vertical lens cuts. The vertical lens cuts can be adjacent to each other in the horizontal direction and connected to each other via sharp vertical valleys.

Figure 11:
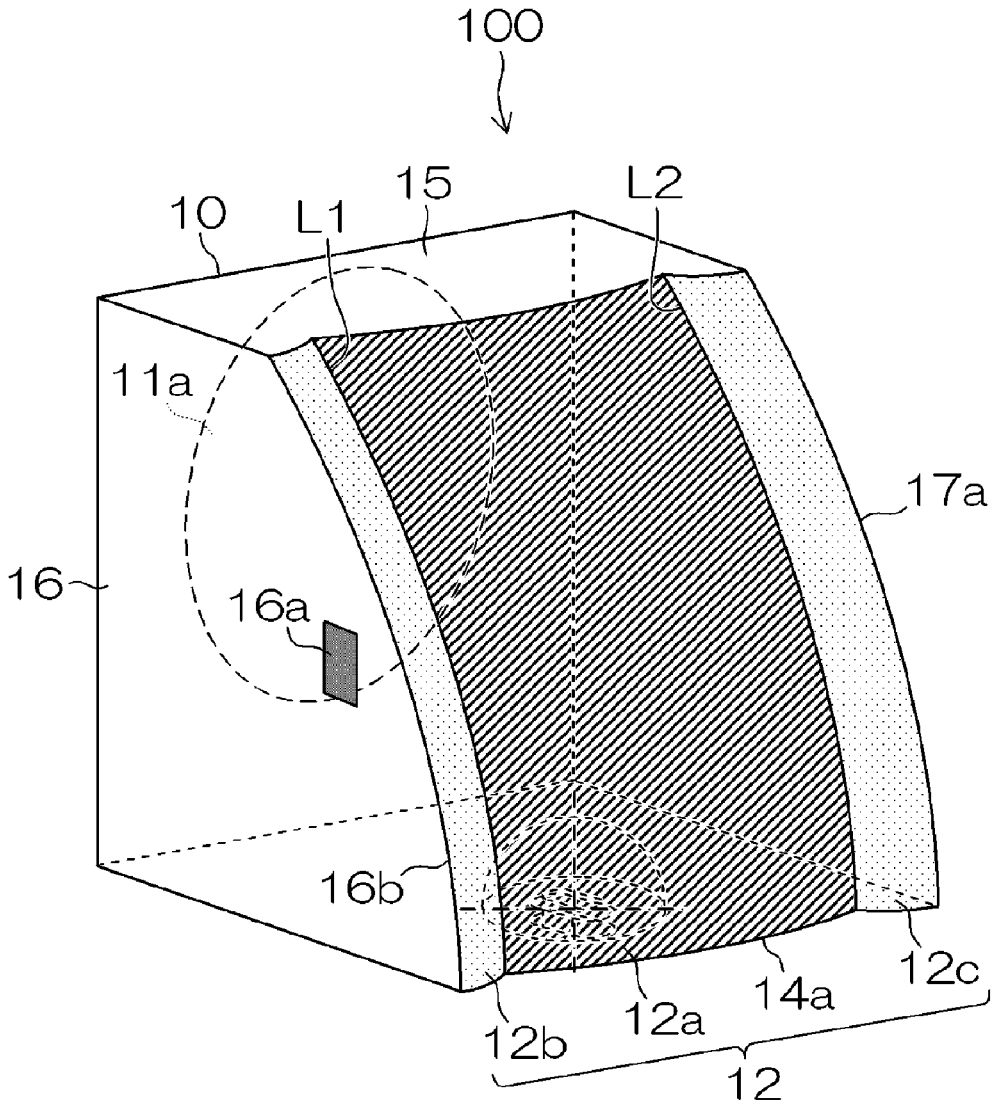
FIG. 11 is a perspective view illustrating the light, which is further another modified example of the previous exemplary embodiment of FIG. 7.

FIG. 11 illustrates another exemplary embodiment wherein adjacent connecting surfaces 12*b* (12*c*) can be subjected to grain finishing resulting in a grain-finished surface.

In this exemplary embodiment, the grain-finished adjacent connecting surfaces 12*b* (12*c*) can diffuse the image of the resin injection trace 16*a* reflected in the adjacent connecting surface 12*b* (12*c*) to prevent the image of the resin injection trace 16*a* from being recognized through the projecting surface 11*a* as a resin injection trace.

Thus, the vehicle light 100 can prevent deterioration of appearance due to a reflected image of the resin injection trace 16*a* in the adjacent connecting surface 12*b* (12*c*) viewed through the projecting surface 11*a*.

Further, even if an unintended light beam is incident on the adjacent connecting surface 12*b* (12*c*), the light beam can be diffused by the grain-finished adjacent connecting surface 12*b* (12*c*), thereby eliminating the adverse effect to the optical surfaces (the incident surface 14*a*, the reflecting surface 12*a* and the projecting surface 11*a*). This configuration can prevent the unintended light beam from becoming glare light by the adjacent connecting surface 12*b*.

Further, the grain-finished adjacent connecting surfaces 12*b* (12*c*) can provide an additional light emission area that can be viewed through the projecting surface 11*a* by its diffusion effect, thereby improving the visibility as a vehicle light as well as its safety.

A description will now be made below to a vehicle light of the presently disclosed subject matter with reference to the accompanying drawings in accordance with still another exemplary embodiment.

Figure 12:
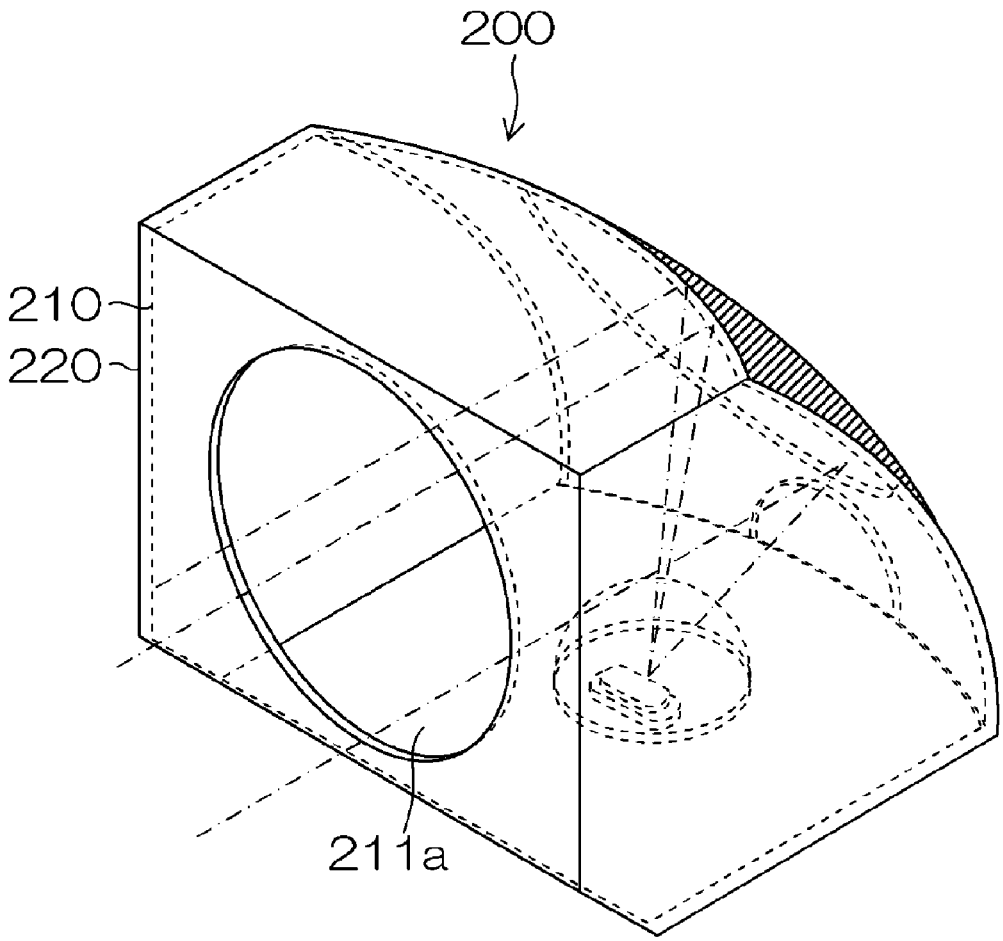
FIG. 12 is a perspective view illustrating a light according to still another exemplary embodiment made in accordance with principles of the presently disclosed subject matter.

A vehicle light 200 of the present exemplary embodiment as shown in FIG. 12 can be applied to a vehicle light (for example, a headlamp, a signal lamp and the like for use in automobiles, motorcycles and the like). The vehicle light 200 of FIG. 12 can include a lens body 210 made of a transparent resin, a colored resin layer 220, a light source 230, and the like. The lens body 210 can include a resin injection trace 216*a* (or so-called gate trace) which results from an injection molding.

Figure 13:
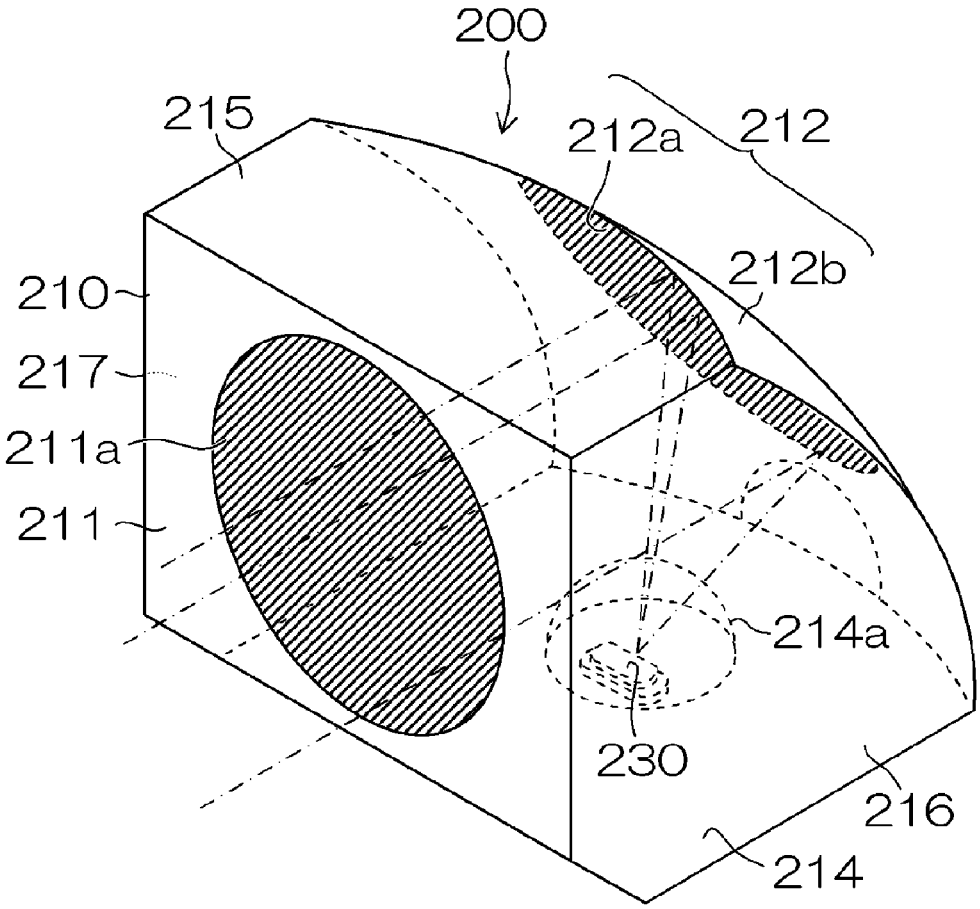
FIG. 13 is a perspective view illustrating a lens body for use in the vehicle light of the exemplary embodiment of FIG. 12.
Figure 14:
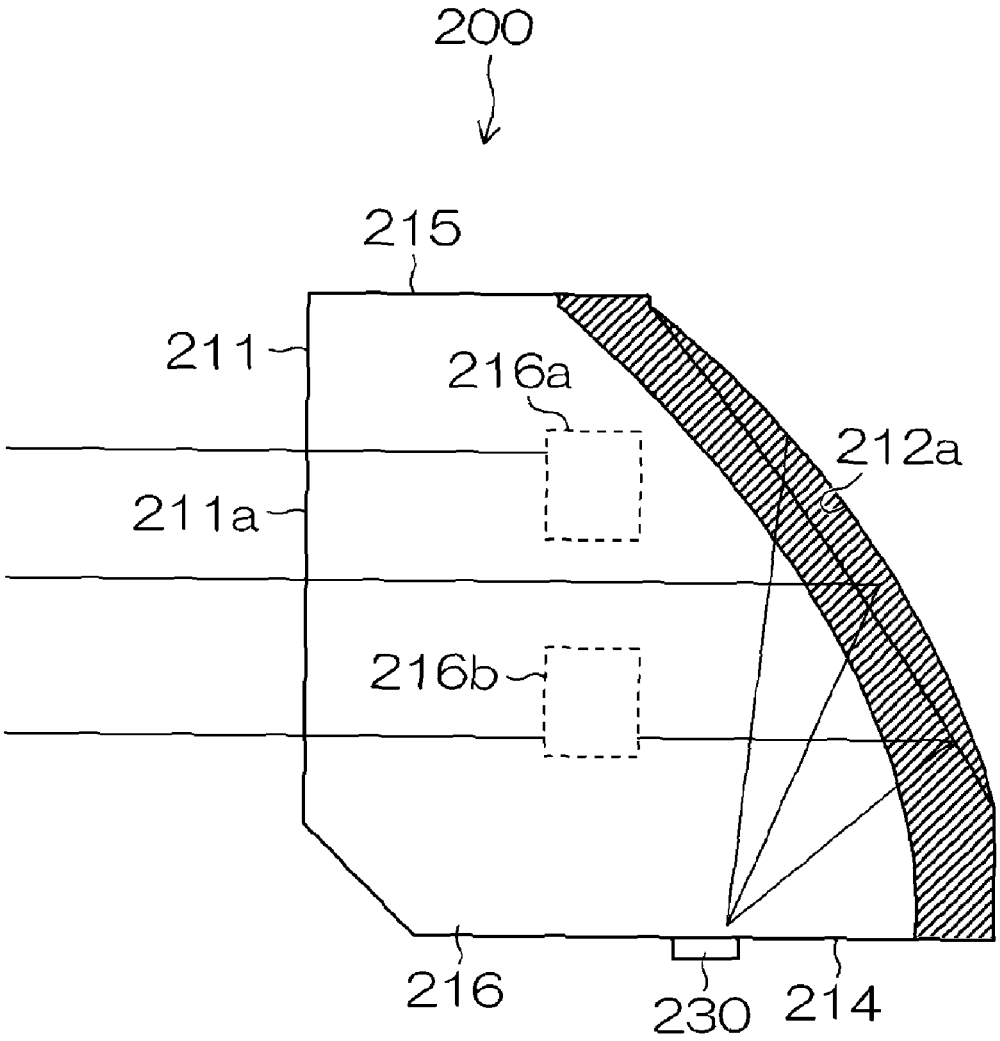
FIG. 14 is a side view illustrating the lens body of FIG. 13.

The lens body 210 can be molded by injection molding a transparent resin such as acrylic resin, polycarbonate resin or the like to be a solid lens body. As shown in FIG. 13, the lens body 210 can include a front surface 211 that is positioned in the front side of a vehicle body and can include a projecting surface 211*a*, a rear surface 212 that is positioned in the rear side and can include a reflecting surface 212*a* and an adjacent connecting surface 212*b* (that does not engage in the formation of a predetermined light distribution pattern), a bottom surface 214 that includes an incident surface 214*a*, an upper surface 215, and side surfaces 216 and 217 including the resin injection trace 216*a* and 216*b* (being a trace formed by an injection molding gate). These surfaces can define the lens body 210 as a substantially cubic shape. In the present exemplary embodiment, the colored resin layer 220 can cover the resin injection traces 216*a* and 216*b*, and accordingly, the resin injection traces 216*a* and 216*b* may be disposed at positions where one can see them through the front surface 211 side.

The incident surface 214*a* can be a lens surface that can allow the light emitted from the light source 230 to enter the lens body 210, and can be formed in the bottom surface 214. As shown in FIG. 13, the incident surface 214*a* is shown as a semispherical concave surface indented toward the inside of the lens body 210.

The reflecting surface 212*a* can be configured to reflect the incident light from the light source 230 in a predetermined direction so as to form a predetermined light distribution pattern, and can be a revolved parabolic reflecting surface. The reflecting surface 212*a* can be formed by, for example, covering the surfaces of the lens body 210 other than the optical surfaces (the incident surface 214*a*, the reflecting surface 212*a* and the projecting surface 211*a*), namely covering the connecting surfaces, with a colored resin layer 220, and then depositing metal such as Al on a circular convex surface to be a reflecting surface. Note that the connecting surfaces excluding the circular convex reflecting surface can be masked with the colored resin layer 220, a conventional masking operation is not required during the deposition of metal.

The projecting surface 211*a* can be a lens surface configured to project light directly from the light source 230 and/or the light reflected from the reflecting surface 212*a*, and can be formed in the front surface 211 of the lens body 210. The projecting surface 211*a* can be covered with an anti-reflection film, if necessary. The connecting surfaces other than the optical surfaces (the incident surface 214*a*, the reflecting surface 212*a* and the projecting surface 211*a*) can be masked with the colored resin layer 220. Accordingly, when the anti-reflection film is deposited on the projecting surface 212*a* and the incident surface 214*a* by deposition, it is possible to prevent the anti-reflection film from being deposited on the connecting surfaces (including the adjacent connecting surface 212*b*). This configuration can prevent light from becoming glare light due to the unintended anti-reflection film formed on the connecting surfaces (including the adjacent connecting surface 212*b*).

The light source 230 can be composed of one or a plurality of LED chips in a packaged form. The light source 230 can be fixed to the lens body 210 by means of, for example, a sealant like a transparent resin so that the light emitted therefrom can be incident on the incident surface 214*a* of the lens body 210. Since an LED is utilized as the light source 230, the adverse effect of heat on the resin-made lens body 210 can be reduced.

The connecting surface 212*b* (corresponding to the adjacent connecting surface surrounding the reflecting surface in claims) can be configured to shape and define the structure of the lens body 210, but does not engage in the formation of the light distribution pattern. Here, the connecting surface 212*b* can be formed in the rear surface 212 to surround the reflecting surface 212*a* as shown in FIG. 13.

Figure 15:
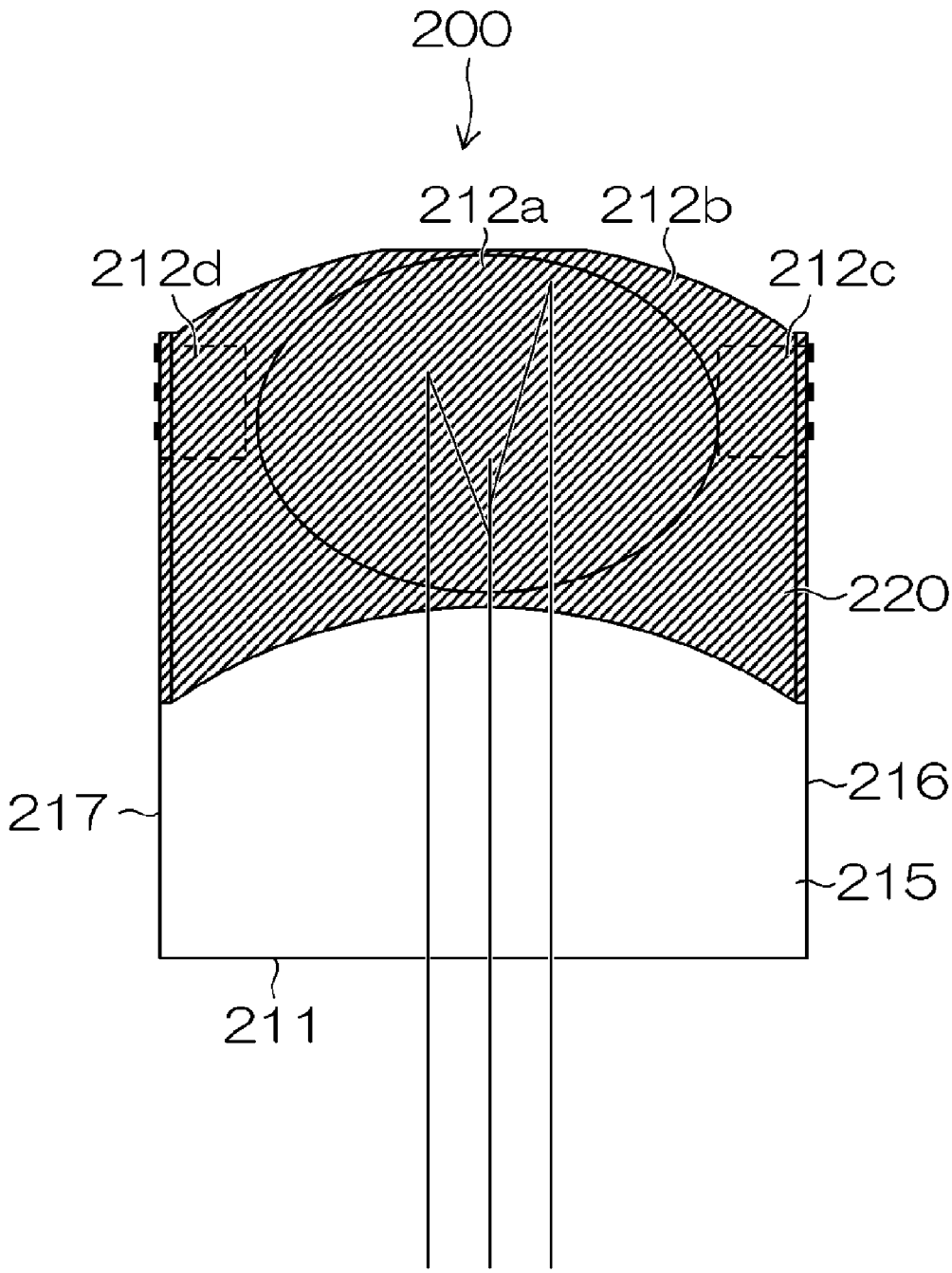
FIG. 15 is a top view illustrating the lens body of FIG. 13.

The colored resin layer 220 can be formed by, for example, two-color injection molding (secondary molding) a colored resin (for example, a substantially black resin that cannot allow light to pass therethrough or can allow light to barely pass therethrough as would be perceptible by the human eye). The thickness of the colored resin layer 220 can be approximately 1 mm. As a result, all of or part of the surfaces of the lens body 210 other than the optical surfaces (the incident surface 214*a*, the reflecting surface 212*a* and the projecting surface 211*a*), namely the connecting surfaces, can be covered with the colored resin layer 220. FIG. 12 illustrates one example of the present exemplary embodiment, wherein all of the connecting surfaces are covered with the colored resin layer 220. FIG. 15 illustrates a modified example of the present exemplary embodiment, wherein part of the connecting surfaces is covered with the colored resin layer 220.

Accordingly, this configuration can prevent the unintended light beam from being reflected by the connecting surface 212*b* and being projected. In other words, this configuration can prevent the light beam emitted from the LED light source 230 and entering the lens body 210 from becoming glare light by the adjacent connecting surface 212*b*.

Furthermore, the colored resin layer 220 can cover the resin injection traces 216*a* and 216*b* that are formed by the primary molding.

During the secondary molding, another resin injection trace may be generated, and the position of such a resin injection trace may be designed to be arranged on an area where it cannot be observed when viewed from the front side. Examples of the position include the rear surface 212, bottom surface 214, and the like. FIG. 15 illustrate a modified example wherein the resin injection traces 212*c* and 212*d* generated during the secondary molding are disposed on the adjacent connecting surface 212*b*.

As described above, in accordance with the present exemplary embodiment, the surfaces of the lens body 210 other than the optical surfaces (the incident surface 214*a*, the reflecting surface 212*a* and the projecting surface 211*a*), namely the connecting surfaces, can be covered with the colored resin layer 220 (or semitransparent resin layer). Accordingly, without providing a separate light-blocking cover, this configuration can prevent the unintended light beam from being reflected by the connecting surface 212*b* and being projected.

In other words, this configuration can prevent the light beam emitted from the LED light source 230 and entering the lens body 210 from becoming glare light by the adjacent connecting surface 212*b*.

Furthermore, in this embodiment, the connecting surfaces other than the optical surfaces (the incident surface 214*a*, the reflecting surface 212*a* and the projecting surface 211*a*) can be masked with the colored resin layer 220. Accordingly, when an anti-reflection film is deposited on the projecting surface 212*a* and the incident surface 214*a* by deposition, it is possible to prevent the anti-reflection film from being deposited on the connecting surfaces (including the adjacent connecting surface 212*b*). Therefore, it is possible to prevent light from becoming glare light due to the unintended anti-reflection film formed on the connecting surfaces (including the adjacent connecting surface 212*b*).

In addition, the colored resin layer 220 can cover the resin injection traces 216*a* and 216*b* that are generated during the primary molding. This configuration can prevent the reflected image of the resin injection traces 216*a* and 216*b* in the adjacent connecting surface 212*b* from being observed through the projecting surface 211*a*.

Thus, the vehicle light 200 can prevent the deterioration of appearance due to the reflected image of the resin injection trace 216*a* and 216*b* in the adjacent connecting surface 212*b* being viewable through the projecting surface 211*a*.

The present exemplary embodiment including the colored resin layer 220 can enhance the degree of freedom in design because the surfaces other than the optical surfaces (the incident surface 214*a*, the reflecting surface 212*a* and the projecting surface 211*a*), namely the connecting surfaces, can be colored.

In the present exemplary embodiment, the surfaces of the lens body 210 other than the optical surfaces (the incident surface 214*a*, the reflecting surface 212*a* and the projecting surface 211*a*) can be covered with the colored resin layer 220.

The colored resin layer may alternatively or in addition be formed of a translucent white colored resin. The translucent white colored resin layer 220 can provide, in addition to the same advantageous effects as described above, other advantageous effects wherein the transparent feeling (sense) and the feel of a material of the lens body 210 can be maintained while unnecessary light that may become glare light can be prevented from being diffused or otherwise emitted. Furthermore, in this case the entire lens body 210 can be observed to emit light, thereby enhancing the visibility and improving its aesthetic appearance.

Next, still another modified example will be described.

In the above exemplary embodiments, the vehicle light (100, 200) can be configured such that the predetermined light distribution pattern can be formed by reflecting the light within the lens body (10, 210) once, but the presently disclosed subject matter is not limited to this. For example, the lens body can include a plurality of reflecting surfaces there-inside so that the light entering the lens body can be reflected two or more times by these reflecting surfaces for forming a required light distribution pattern.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A light comprising:

a light source; and a lens body having a resin injection trace formed by injection molding, and having a plurality of surfaces, including optical surfaces including an incident surface, a reflecting surface, and a projecting surface that are configured to form a predetermined light distribution pattern, the incident surface including a lens surface configured to receive light from the light source to allow the light to enter the lens body, the reflecting surface configured to reflect the light from the light source toward the projecting surface so as to form the light distribution pattern, the projecting surface including a lens surface configured to receive the light directly from the light source and the light reflected by the reflecting surface and to project the light, and connecting surfaces that shape and define a structure of the lens body by connecting the optical surfaces, but that do not engage in the formation of the light distribution pattern, the connecting surfaces including an adjacent connecting surface surrounding the reflecting surface, and configured to have a shape that does not generate a light path from the resin injection trace via the connecting surface to the projecting surface.

2. The light according to claim 1, wherein the light source is an LED light source.

3. The light according to claim 2, wherein the lens body is an injection molded transparent resin unit.

4. The light according to claim 3, wherein:

the lens body has a substantial cubic shape including a bottom surface, side surfaces, a front surface, a rear surface and a top surface;

the incident surface is arranged in the bottom surface;

the projecting surface is arranged in the front surface;

the reflecting surface is arranged in the rear surface;

the adjacent connecting surface is arranged in the same rear surface as the reflecting surface, so that the adjacent connecting surface obscures light from the light source reflected from the resin injection trace.

5. The light according to claim 4, wherein the light is a vehicle light.

6. A light comprising:

a light source; and a lens body having a resin injection trace formed by injection molding, and having a plurality of surfaces, including optical surfaces including an incident surface, a reflecting surface, and a projecting surface that are configured to form a predetermined light distribution pattern, the incident surface including a lens surface configured to receive light from the light source to allow the light to enter the lens body, the reflecting surface configured to reflect the light from the light source toward the projecting surface so as to form the light distribution pattern, the projecting surface including a lens surface configured to receive the light directly from the light source and the light reflected by the reflecting surface and to project the light, and connecting surfaces that shape and define a structure of the lens body by connecting the optical surfaces, but that do not engage in the formation of the light distribution pattern, the connecting surfaces including an adjacent connecting surface surrounding the reflecting surface, and including a shape configured to reflect light from the light source reflected from the resin injection trace so that reflected light from the injection trace is obscured and cannot be recognized as a resin injection trace.

7. The light according to claim 6, wherein the light source is an LED light source.

8. The light according to claim 7, wherein the lens body is an injection molded transparent resin unit.

9. The light according to claim 8, wherein:

the lens body has a substantial cubic shape including a bottom surface, side surfaces, a front surface, a rear surface and a top surface;

the incident surface is arranged in the bottom surface;

the projecting surface is arranged in the front surface;

the reflecting surface is arranged in the rear surface;

the adjacent connecting surface is arranged in the same rear surface as the reflecting surface, so that the adjacent connecting surface obscures the light reflected from the resin injection trace.

10. The light according to claim 9, wherein the light is a vehicle light.

11. A light comprising:

a light source; and a lens body having a resin injection trace formed by injection molding, and having a plurality of surfaces, including optical surfaces including an incident surface, a reflecting surface, and a projecting surface that are configured to form a predetermined light distribution pattern, the incident surface including a lens surface configured to receive light from the light source to allow the light to enter the lens body, the reflecting surface configured to reflect the light from the light source toward the projecting surface so as to form the light distribution pattern, the projecting surface including a lens surface configured to receive the light directly from the light source and the light reflected by the reflecting surface and to project the light, and connecting surfaces that shape and define a structure of the lens body by connecting the optical surfaces, but that do not engage in the formation of the light distribution pattern, the connecting surfaces including an adjacent connecting surface surrounding the reflecting surface and including a grain-finished surface.

12. The light according to claim 11, wherein the light source is an LED light source.

13. The light according to claim 12, wherein the lens body is an injection molded transparent resin unit.

14. The light according to claim 13, wherein:

the lens body has a substantial cubic shape including a bottom surface, side surfaces, a front surface, a rear surface and a top surface;

the incident surface is arranged in the bottom surface;

the projecting surface is arranged in the front surface;

the reflecting surface is arranged in the rear surface;

the adjacent connecting surface is arranged in the same rear surface as the reflecting surface, so that the adjacent connecting surface obscures light from the light source reflected from the resin injection trace.

15. The light according to claim 14, wherein the light is a vehicle light.

16. A light comprising:

a light source; and a lens body having a resin injection trace formed by injection molding, the lens body including optical surfaces including an incident surface, a reflecting surface, and a projecting surface that are configured to form a predetermined light distribution pattern, the incident surface including a lens surface that can receive light from the light source to allow the light to enter the lens body, the reflecting surface configured to reflect the light from the light source toward the projecting surface so as to form the light distribution pattern, the projecting surface including a lens surface configured to receive the light directly from the light source and the light reflected by the reflecting surface and to project the light, and connecting surfaces that shape and define a structure of the lens body by connecting the optical surfaces, but that do not engage in the formation of the light distribution pattern, the connecting surfaces of the lens body include surfaces other than the optical surfaces and are covered with at least one of a colored layer and a translucent layer.

17. The light according to claim 16, wherein the light source is an LED light source.

18. The light according to claim 17, wherein the lens body is an injection molded transparent resin unit.

19. The light according to claim 18, wherein:

the lens body has a substantial cubic shape including a bottom surface, side surfaces, a front surface, a rear surface and a top surface;

the incident surface is arranged in the bottom surface;

the projecting surface is arranged in the front surface;

the reflecting surface is arranged in the rear surface;

the adjacent connecting surface is arranged in the same rear surface as the reflecting surface, so that the adjacent connecting surface obscures light from the light source reflected from the resin injection trace.

20. The light according to claim 19, wherein the light is a vehicle light.

* * * * *